US005690438A

United States Patent [19]

Tan et al.

[11] Patent Number: 5,690,438

[45] Date of Patent: *Nov. 25, 1997

[54] CONTINUOUS OR ENDLESS LOOP PRINTING RIBBON CASSETTES AND REINKING DEVICES THEREFOR

[75] Inventors: Yaoping Tan, Miamisburg; Bernard P. Sheehan, Cincinnati, both of Ohio

[73] Assignee: NCR Corporation, Dayton, Ohio

[ * ] Notice: The term of this patent shall not extend beyond the expiration date of Pat. No. 5,667,317.

[21] Appl. No.: 804,597

[22] Filed: Feb. 24, 1997

Related U.S. Application Data

[63] Continuation of Ser. No. 541,762, Oct. 10, 1995, abandoned, which is a continuation of Ser. No. 173,582, Dec. 2, 1993, abandoned.

[51] Int. Cl.[6] ..... B41J 31/14

[52] U.S. Cl. ..... 400/197; 400/196.1

[58] Field of Search ..... 400/197, 196.1, 400/202.1, 202.2, 202.4

[56] References Cited

U.S. PATENT DOCUMENTS

| | | | |
|---|---|---|---|
| 2,760,464 | 8/1956 | Roggenburger | 400/202.4 |
| 4,340,313 | 7/1982 | Bishop | 400/202.1 |
| 4,636,097 | 1/1987 | Goubeaux | 400/197 |
| 4,653,947 | 3/1987 | Echols | 400/196.1 |
| 4,747,711 | 5/1988 | Motta et al. | 400/202.4 |
| 4,968,161 | 11/1990 | Kunitomi et al. | 400/196.1 |
| 5,005,996 | 4/1991 | Paterra et al. | 400/196.1 |
| 5,215,012 | 6/1993 | Kanno et al. | 400/196.1 |

FOREIGN PATENT DOCUMENTS

| | | | |
|---|---|---|---|
| 0118487 | 7/1984 | Japan | 400/202.2 |
| 59-118487 | 7/1984 | Japan | 400/202 |
| 4292979 | 10/1992 | Japan | 400/202.4 |
| 4345881 | 12/1992 | Japan | 400/202.4 |

OTHER PUBLICATIONS

IBM Technical Disclosure Bulletin, vol. 33, No. 2, Jul., 1990 "Reink Roller Housing," p. 106.

*Primary Examiner*—Edgar S. Burr
*Assistant Examiner*—Anthony H. Nguyen
*Attorney, Agent, or Firm*—Craig E. Miller

[57] ABSTRACT

Continuous or endless loop printing ribbon cassettes and reinking devices therefor which will control the start of reinking transfer flow and the reinking transfer flow rate from the reinking device to the continuous or endless loop printing ribbon fabric substrate. One preferred embodiment of the reinking device in accordance with the present invention utilizes two cylindrical ink rolls positioned concentric to each other. The inner ink roll is saturated with an ink having a normal flow rate and acts as a reservoir. The outer ink roll is saturated with an ink having a higher viscosity or other materials which delay the start of reinking transfer flow when the continuous or endless printing ribbon cassette is new and controls the ink transfer flow rate during the useful life of the continuous or endless loop printing ribbon cassette. In a second preferred embodiment, the inner ink roll is replaced by an inner ink reservoir which controls the ink transfer flow rate to the porous outer ink roll.

5 Claims, 4 Drawing Sheets

CONTINUOUS OR ENDLESS LOOP PRINTING RIBBON CASSETTES AND REINKING DEVICES THEREFOR

This is a continuation of application Ser. No. 08/541,762 filed on Oct. 10, 1995, now abandoned, which is a continuation of Ser. No. 08/173,582 filed on Dec. 22, 1993, now abandoned.

BACKGROUND AND SUMMARY OF THE INVENTION

The present invention relates generally to new and novel improvements in continuous or endless loop printing ribbon cassettes and reinking devices therefor. More particularly, the present invention relates to continuous or endless loop printing ribbon cassettes and reinking devices therefor which provide a controlled uniform rate of ink transfer flow from the reinking devices to the continuous or endless loop printing ribbons in continuous or endless loop printing ribbon cassettes.

Continuous or endless loop printing ribbon cassettes, generally utilizing a continuous or endless loop printing ribbon fabricated with a fabric substrate, have found wide acceptance as a source of printing ink for printing operations carried out by a variety of printers. Such continuous or endless loop printing ribbon cassettes generally produce dark images and characters when new, but the darkness of the printed images and characters gradually fades as the ink originally present in the continuous or endless loop printing ribbon is consumed during the printing process.

Several reinking devices have been used in an attempt to reduce the rate of fading of printed images and characters from such continuous or endless loop printing ribbons and thereby extend the useful life of the continuous or endless loop printing ribbon cassettes. One known type of reinking device commonly used in conjunction with continuous or endless loop printing ribbon cassettes utilizes roller type reinkers. Such roller type reinkers generally consist of a cylindrical porous rubber or foam member which has been impregnated with a liquid ink. The liquid ink is transferred from the roller type reinkers to the continuous or endless loop printing ribbons through either direct contact between the roller type reinker and the continuous or endless loop printing ribbon or through indirect contact by use of a transfer roll positioned between the roller type reinker and the continuous or endless loop printing ribbon.

Such traditional roller type reinkers have several disadvantages. First, there is only limited control over the transfer of ink from the roller type reinker to the continuous or endless loop printing ribbon. Generally, the reinking transfer flow rate of such roller type reinkers decreases as the amount of ink originally present in the roller type reinkers is depleted. Thus, as printing operations continue during the useful life of the continuous or endless printing ribbon cassette, ink originally present in the continuous or endless loop printing ribbon is being consumed, and ink from the roller type reinker is continuously being transferred at a steadily decreasing transfer flow rate from the roller type reinker to the continuous or endless loop printing ribbon. Therefore, when a new continuous or endless loop printing ribbon cassette is installed on a printer, the continuous or endless loop printing ribbon fabric substrate may have excessive ink, causing undesirable running and smearing of printed images and characters. Then, as ink originally present in the continuous or endless loop printing ribbon cassette is used, the rate of ink transfer flow from the continuous or endless loop printing ribbon, as well as the rate of ink transfer flow from the roller type reinker to the continuous or endless printing ribbon, gradually decreases, causing printed images and characters to become progressively lighter throughout the useful life of the continuous or endless loop printing ribbon cassette. Thus, traditional roller type reinkers do not solve the problem of printed images and characters from continuous or endless loop printing ribbon cassettes becoming progressively lighter over time. Furthermore, the expected improvement in the useful life of the continuous or endless loop printing ribbon cassette is less than expected.

Secondly, as discussed previously, the ink originally present in traditional roller type reinkers flows out rapidly when the continuous or endless loop printing ribbon cassettes are originally installed on the printer. However, at this time, the continuous or endless loop printing ribbon still has most, if not all, of its original ink supply. While continuous or endless loop printing ribbon cassette design modifications have sometimes been used to control the ink transfer flow rate from roller type reinkers to the continuous or endless loop printing ribbon, these designs are undesirable because they generally require operator intervention to modify the ink transfer flow rate from the roller type reinkers to the continuous or endless loop printing ribbon.

A second known type of reinking device commonly used in conjunction with continuous or endless loop printing ribbon cassettes utilizes a felt or reticulated foam reservoir which transfers ink to a transfer roll, or through a wick to a transfer roll, which in turn transfers the ink to the continuous or endless loop printing ribbon. These reinking devices generally utilize capillary action to provide flow or transfer of ink from the felt or reticulated foam reservoir to the transfer roll. However, these types of reinking devices also have several disadvantages. First, the felt or reticulated foam reservoir is often originally supersaturated to support the capillary action. This degree of supersaturation may result in leakage or running and smearing of printed images and characters. Furthermore, if pigments are used in the reinker ink formulation, these pigments may reduce or block the ink transfer flow of reinker ink from the felt or reticulated foam reservoir to the continuous or endless loop printing ribbon.

Accordingly, an object of the present invention is the provision of continuous or endless loop printing ribbon cassettes and reinking devices therefor which provide a controlled uniform ink transfer flow rate from the reinking devices to continuous or endless loop printing ribbons in continuous or endless loop printing ribbon cassettes.

Another object of the present invention is to provide continuous or endless loop printing ribbon cassettes and reinking devices therefor which extend the useful life of the continuous or endless loop printing ribbon cassettes.

A further object of the present invention is to provide continuous or endless loop printing ribbon cassettes and reinking devices therefor which result in printed images and characters having a more consistent darkness throughout the useful life of the continuous or endless loop printing ribbon cassettes.

Still a further object of the present invention is to provide continuous or endless loop printing ribbon cassettes and reinking devices therefor which reduce the possibility of excessive ink originally present in the reinking device causing leakage of the ink from the reinking device and running and smearing of printed images and characters.

These and other objects of the present invention are attained by the provision of continuous or endless loop printing ribbon cassettes and reinking devices therefor which are capable of controlling the start of reinking transfer flow and the rate of ink transfer flow from the reinking devices to the continuous or endless loop printing ribbon fabric substrates. One preferred embodiment of the reinking device in accordance with the present invention utilizes two cylindrical ink rolls positioned concentric to each other. The inner cylindrical ink roll is preferably saturated with an ink having a normal flow rate and acts as a reservoir. The outer cylindrical ink roll is preferably saturated with an ink having a higher viscosity or other materials which can delay the start of reinking transfer flow when the continuous or endless loop printing ribbon cassette is relatively new and control the reinking transfer flow rate during the remaining useful life of the continuous or endless loop printing ribbon cassette. In a second preferred embodiment of the reinking device in accordance with the present invention, the inner cylindrical ink roll is replaced by an ink reservoir which controls the transfer flow rate of ink to the outer cylindrical ink roll. In a third preferred embodiment of the reinking device in accordance with the present invention, the inner cylindrical ink roll is replaced by an inner ink retention member which controls the transfer flow rate of ink to the outer cylindrical ink roll.

Other objects, advantages and novel features of the present invention will become apparent in the following detailed description of the invention when considered in conjunction with the accompanying drawings.

DETAILED DESCRIPTION OF THE DRAWINGS

Figure 1:
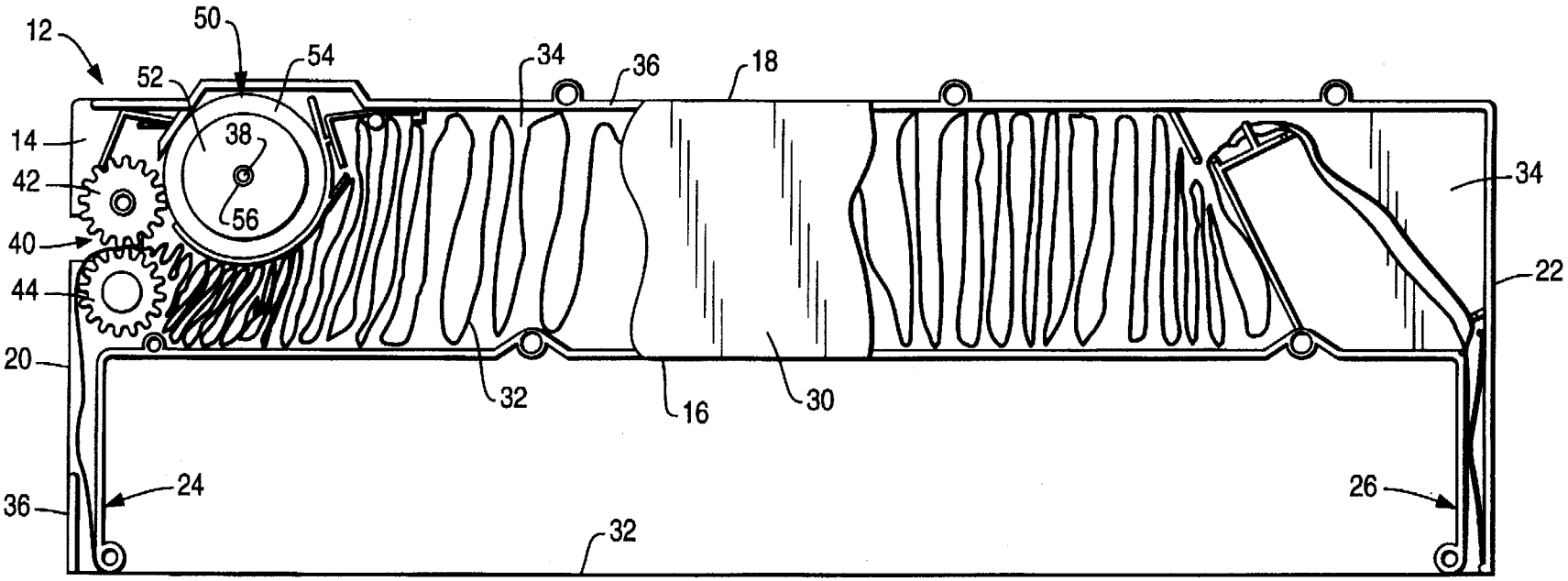
FIG. 1, which illustrates a first preferred embodiment of the continuous or endless loop printing ribbon cassette and reinking device therefor in accordance with the present invention, shows a top view of a continuous or endless loop printing ribbon cassette with reinking device with portions of the printing ribbon cassette cover broken away for the purpose of illustration.

Referring now to the drawings, in which like-referenced characters indicate corresponding elements throughout the several views, attention is first drawn to FIG. 1 which illustrates a first preferred embodiment of a continuous or endless loop printing ribbon cassette and reinking device therefor, generally identified by reference numeral 10, in accordance with the present invention. Continuous or endless printing ribbon cassette 10 generally includes printing ribbon cassette base 12, printing ribbon cassette cover 30, continuous or endless loop printing ribbon 32 and printing ribbon drive gear mechanism 40.

Printing ribbon cassette base 12 is of a generally rectangular configuration having bottom portion 14, front portion 16, rear portion 18, inlet side portion 20 and outlet side portion 22. Wall 36 extends upwardly from bottom portion 14 around the perimeter of printing ribbon cassette base 12 along front portion 16, rear portion 18, inlet side portion 20 and outlet side portion 22. Inlet guide 24 and outlet guide 26 assist in controlling the path of continuous or endless loop printing ribbon 32 into and out of the printing equipment (not shown).

Continuous or endless loop printing ribbon 32 extends outwardly from outlet guide 26, and is fed through the printing equipment (not shown) where a printed image or character is formed by forcing a predetermined portion of continuous or endless loop printing ribbon 32, typically by an impact printer head (not shown), into contact with a print receiving medium, for example paper (not shown). Continuous or endless loop printing ribbon 32 then reenters continuous or endless loop printing ribbon cassette 10 through inlet guide 24 and is stored in continuous or endless loop printing ribbon storage cavity 34. Since continuous or endless loop printing ribbon 32 has no ends, i.e., it forms a continuous loop, such movement can continue indefinitely, or as a practical matter until the printing ink remaining in continuous or endless loop printing ribbon 32 is insufficient to produce printed images or characters having adequate darkness.

Continuous or endless loop printing ribbon 32 is fed into continuous or endless loop printing ribbon storage cavity 34 by printing ribbon drive gear mechanism 40. Printing ribbon drive gear mechanism 40 includes primary drive gear 42 which is driven by the printing equipment (not shown). Typically, the printing equipment (not shown) indexes primary drive gear 42 a predetermined amount each time a printing operation is performed. Such indexing presents a fresh portion of continuous or endless loop printing ribbon 32 to the impact printing head (not shown) for each printing operation.

Primary drive gear 42 engages with secondary idler gear 44 to secure continuous or endless loop printing ribbon 32 therebetween. Primary drive gear 42 rotates in a direction opposite to that of secondary idler gear 44 to move continuous or endless loop printing ribbon 32 held therebetween from inlet guide 24 into continuous or endless loop printing ribbon storage cavity 34. While various configurations of gear teeth have been utilized on primary drive gear 42 and secondary idler gear 44, applicant has found that a relatively coarse gear configuration provides several advantages. Such a relatively coarse gear configuration resists slippage between continuous or endless loop printing ribbon 32, and primary drive gear 42 and secondary idler gear 44. Also, a relatively coarse gear configuration appears to assist continuous or endless loop printing ribbon 32 in assuming a more compact storage pattern within continuous or endless loop printing ribbon storage cavity 34. This more compact storage pattern permits continuous or endless printing ribbon 32 of a longer length to be stored in continuous or endless loop printing ribbon storage cavity 34 of a given volume, thus permitting more printing operations to be performed before the quality of the printed images or characters deteriorate to the point where replacement of continuous or endless loop printing ribbon cassette 10 is needed.

Reinking device 50 generally includes inner cylindrical ink roll 52 and outer cylindrical ink roll 54 positioned concentric to inner cylindrical ink roll 52. This is in contrast to many conventional roll type reinkers which consist of a single pore size porous rubber or reticulated foam. Reinking device 50 also includes central aperture 56 in inner cylindrical ink roll 54. Reinking device 50 is mounted on printing ribbon cassette base 12 by positioning central aperture 56 over upstanding pin 38 extending from printing ribbon cassette base 12. Central aperture 56 is preferably larger in diameter than upstanding pin 38 which allows inner cylindrical ink roll 52 and outer cylindrical ink roll 54 to rotate freely around upstanding pin 38, preferably together as a single integral unit.

In the present invention, inner cylindrical ink roll 52 and outer cylindrical ink roll 54 may or may not use the same pore size porous material. In one preferred embodiment of the present invention, inner cylindrical ink roll 52 is saturated with an ink having a normal ink flow rate and acts as a reservoir. Outer cylindrical ink roll 54 is saturated with an ink having a higher than normal ink flow rate or some other materials to control the rate of reinking when continuous or endless loop printing ribbon cassette 10 is mounted and operated on the printing equipment (not shown). When continuous or endless printing ribbon cassette 10 is mounted on the printing equipment (not shown), outer cylindrical ink roll 54 having the ink with a higher than normal flow rate or some other materials to control the reinking transfer flow rate to continuous or endless loop printing ribbon 32 transfers ink to continuous or endless loop printing ribbon 32 at a relatively slow rate. At the same time, the ink with a normal ink flow rate in inner cylindrical ink roll 52 begins to migrate from inner cylindrical ink roll 52 to outer cylindrical ink roll 54 resulting in a mixture of the two inks in outer cylindrical ink roll 54. AS this reinking process continues during the effective life of continuous or endless printing ribbon cassette 10, the viscosity of the mixture of the two inks in outer cylindrical ink roll 54 gradually decreases, resulting in a gradual increase in the ink transfer flow rate from outer cylindrical ink roll 54 to continuous or endless loop printing ribbon 32 through secondary idler gear 44 until an equilibrium is reached. During this period, the darkness of printed images or characters remains relatively constant.

The ink transfer flow rate from inner cylindrical ink roll 52 to outer cylindrical ink roll 54, and from outer cylindrical ink roll 54 to continuous or endless loop printing ribbon 32 through secondary idler gear 44 can be controlled by adjusting the viscosity or flow characteristics of the inks used in inner cylindrical ink roll 52 and outer cylindrical ink roll 54, the pore size of inner cylindrical ink roll 52 and outer cylindrical ink roll 54 and the diameter ratios of inner cylindrical ink roll 52 and outer cylindrical ink roll 54. In addition, ink soluble materials such as stearic acid, waxes and other suitable materials may be used in or on outer cylindrical ink roll 54 to slow or delay the initiation of ink transfer from outer cylindrical ink roll 54 to continuous or endless loop printing ribbon 32 through secondary idler gear 44. By using such techniques, the start of reinking can be delayed to any desired point in the useful life of continuous or endless loop printing ribbon cassette 10. Such delay can be utilized to minimize the likelihood of over inking of continuous or endless loop printing ribbon 32 when continuous or endless loop printing ribbon cassette 10 is relatively new and therefor extends the useful life of continuous or endless loop printing ribbon cassette 10.

A thixotropic ink which, in a static state, has a gelatin-like viscosity and, in a dynamic state, has a fluid-like viscosity may be used in outer cylindrical ink roll 54 to restrict ink migration between inner cylindrical ink roll 52 and outer cylindrical ink roll 54, and between outer cylindrical ink roll 54 and continuous or endless loop printing ribbon 32 through secondary idler gear 44 when continuous or endless loop printing ribbon cassette 10 is being stored, or is otherwise not in use. Use of a trixotropic ink in outer cylindrical ink roll 54 has been found to minimize ink leakage and extend the shelf store life of continuous or endless printing ribbon cassette 10.

Figure 2:
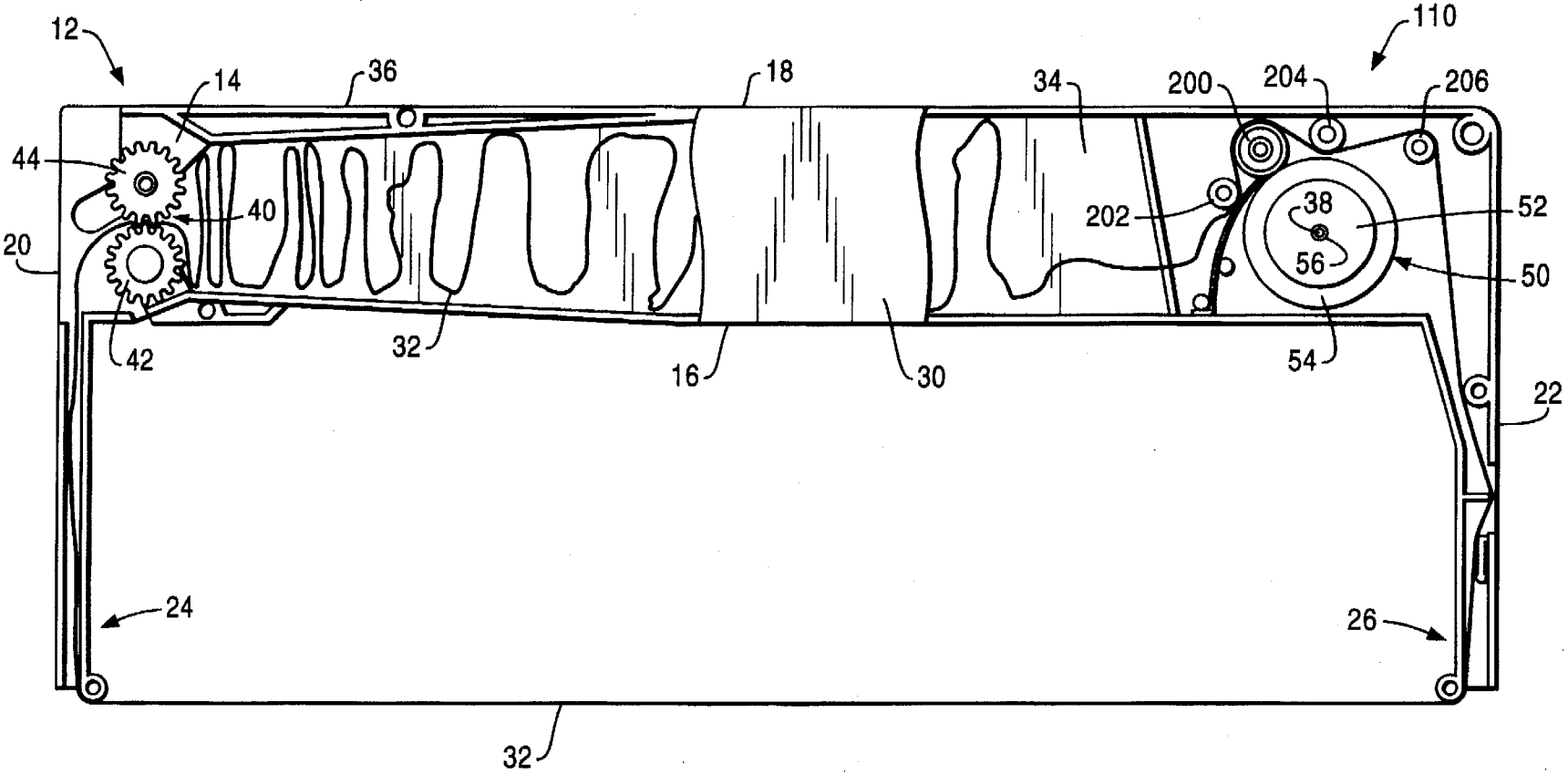
FIG. 2, which illustrates a second preferred embodiment of the continuous or endless loop printing ribbon cassette and reinking device therefor in accordance with the present invention, shows a top view of a continuous or endless loop printing ribbon cassette with reinking device with portions of the printing ribbon cassette cover broken away for the purpose of illustration.

Referring now to FIG. 2, a second preferred embodiment of continuous or endless loop printing ribbon cassette, generally identified by reference numeral 110, is shown. Common elements in both continuous or endless loop printing ribbon cassette 10 and continuous or endless loop printing ribbon cassette 110 are identified with the same reference numerals in FIGS. 1 and 2. In continuous or endless loop printing ribbon cassette 110, reinking device 50 is located such that continuous or endless loop printing ribbon 32 is reinked after exiting from continuous or endless loop printing ribbon storage cavity 34. In continuous or endless loop printing ribbon cassette 110, reinking device 50 transfers ink to transfer roll 200, which is in contact with and rotates in response to linear movement of continuous or endless loop printing ribbon 32. Thus, in continuous or endless loop printing ribbon cassette 110, ink is transfered from reinking device 50 through transfer roll 200 to continuous or endless continuous loop printing ribbon 32. A series of guide rolls 202, 204 and 206 guide continuous or endless printing ribbon 32 from continuous or endless printing ribbon storage cavity 34 past transfer roll 200 to outlet guide 26.

Figure 3:
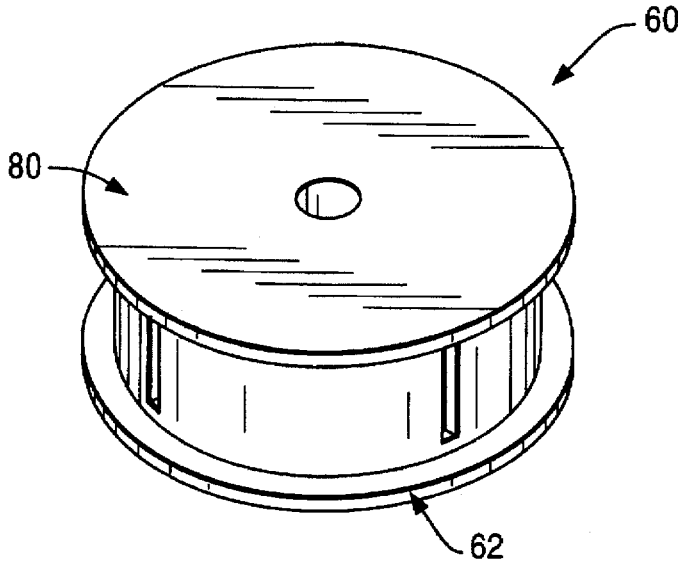
FIG. 3, which illustrates a second preferred embodiment of the reinking device in accordance with the present invention, shows a perspective view of an inner ink reservoir which can be substituted for the inner cylindrical ink roll of the reinking device shown in FIG. 1.
Figure 4:
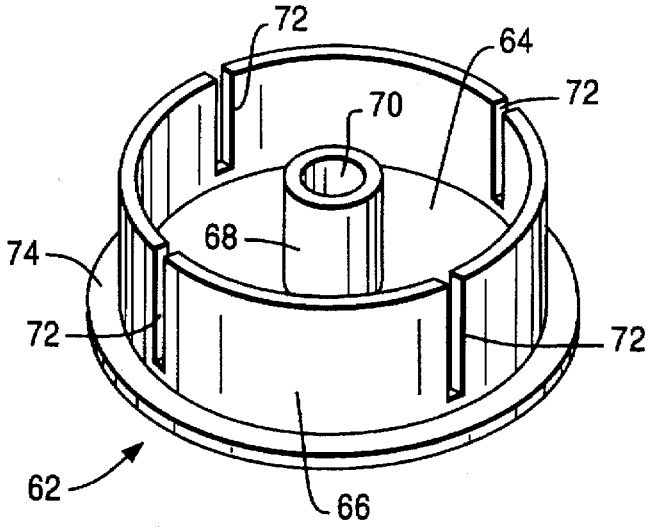
FIG. 4 is a perspective view of the base member of the inner ink reservoir shown in FIG. 3.
Figure 5:
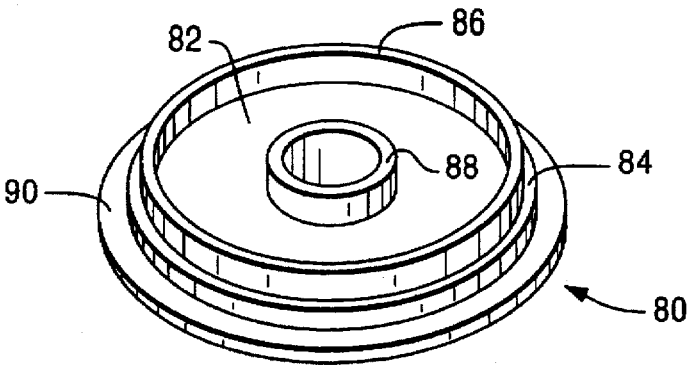
FIG. 5 is a perspective view of the cover member of the inner ink reservoir shown in FIG. 3.

Referring now to FIGS. 3 through 5, illustrating a second preferred embodiment of a reinking device in accordance with the present invention, inner cylindrical ink roll 52 could be replaced by an inner cylindrical ink reservoir, generally indicated by reference numeral 60. Inner cylindrical ink reservoir 60 generally consists of base member 62 and cover member 80. Base member 62 has a generally cylindrical configuration and includes a flat disk-like base 64 and cylindrical wall 66 extending upwardly from base 64. Flat disk-like base 64 is preferably larger in diameter than upstanding cylindrical wall 66 to form outwardly extending flange 74. Centrally positioned cylindrical core 68 also extends upwardly from base 64. Cylindrical core 68 has a centrally positioned aperture 70 which is positioned on upstanding pin 38 when reinking device 50 is mounted on printing ribbon cassette base 12. As in the case of central aperture 56, centrally positioned aperture 70 preferably has a larger inside diameter than the outside diameter of upstanding pin 38 to permit inner cylindrical ink reservoir 60 and outer cylindrical ink roll 54 to rotate freely around upstanding pin 38, preferably together as a single integral unit.

Upstanding cylindrical wall 66 of base member 62 preferably includes one or more slots or apertures 72 which permit controlled transfer flow of ink from the interior of upstanding cylindrical wall 66 to outer cylindrical ink roll 54. The number, size, location and shape of slots or apertures 72 can be adjusted to optimize the ink transfer flow characteristics desired from inner ink reservoir 60 to outer cylindrical ink roll 54.

Cover member 80 generally includes a flat cylindrical disk-like base 82 which transitions through a step to second cylindrical disk-like portion 84. Outer upstanding flange portion 86 extends from the outer peripheral surface of second cylindrical disk-like portion 84 and centrally positioned inner upstanding flange portion 88 extends from second cylindrical disk-like portion 84. Base 82 is preferably larger in outside diameter than second cylindrical disk-like portion 84 forming outwardly extending flange 90.

The outside diameter of outer upstanding flange portion 86 is preferably approximately the same as the inside diameter of upstanding cylindrical wall 66 to allow assembly of base member 62 and cover member 80 by pressing or snapping outer upstanding flange portion 86 inside of upstanding cylindrical wall 66. The presence of slots or apertures 72 in upstanding flange portion 86 permits limited flexibility in upstanding cylindrical wall 66, thus facilitating this assembly procedure. Similarly, the inside diameter of inner upstanding flange portion 88 is preferably approximately the same as the outside diameter of cylindrical core 68 to permit assembly by snapping or pressing these two elements together. The distance between outwardly extending flange 74 and outwardly extending flange 90 when base member 62 is assembled to cover member 80 is preferably dimensioned to accommodate outer cylindrical ink roll 54 therebetween.

One purpose of inner cylindrical ink reservoir 60 is to permit controlled migration of ink to outer cylindrical ink roll 54 during printing operations. Inner cylindrical ink reservoir 60 also contains the ink during storage and thus minimizes the risk of ink leakage therefrom during storage of continuous or endless printing ribbon cassette 10. Inner cylindrical ink reservoir 60 facilitates the migration of reinking ink present in inner cylindrical ink reservoir 60 to outer cylindrical ink roll 54 at an approximately constant rate until the reinking ink originally present in inner cylindrical ink reservoir 60 is depleted. If desirable, inner cylindrical ink reservoir 60 could be designed to be capable of being refilled when the reinking ink originally present is depleted.

Figure 6:
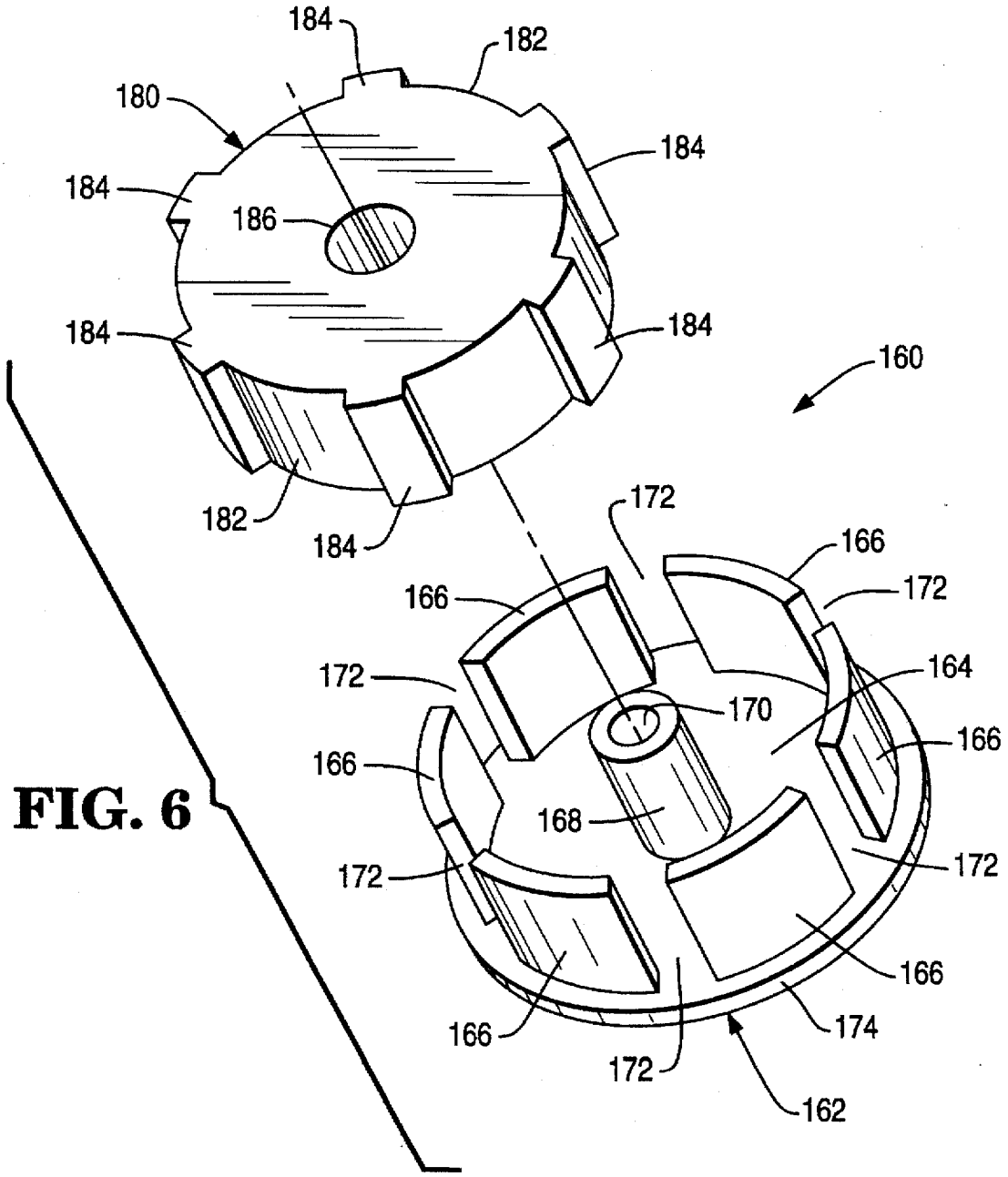
FIG. 6, which illustrates a third preferred embodiment of the reinking device in accordance with the present invention, shows an exploded perspective view of an inner ink retention member which can be substituted for the inner cylindrical ink roll of the reinking device shown in FIG. 1.

Referring now to FIG. 6, showing a third preferred embodiment of a reinking device in accordance with the present invention, inner cylindrical ink roll 52 could be replaced by inner cylindrical ink retention member, generally identified by reference numeral 160. Inner cylindrical ink retention member 160 generally includes inner cylindrical ink retention support member 162 and ink retention member 180. Inner cylindrical ink retention support member 162 has a generally cylindrical configuration and includes flat disk-like base 164 and upstanding wall portions 166 extending upwardly from base 164. Flat disk-like base 164 is preferably larger in diameter than upstanding wall portions 166 to form outwardly extending flange 174 centrally positioned cylindrical core 168 also extends upwardly from base 164. Cylindrical core 168 has a centrally positioned aperture 170 which is positioned on upstanding pin 38 when reinking device 50 is mounted on continuous or endless printing ribbon cassette base 12. As in the case of central aperature 56, centrally positioned aperture 170 preferably has a larger inside diameter than the outside diameter of upstanding pin 38 to allow inner cylindrical ink retention member 160 and outer cylindrical ink roll 54 to rotate freely around upstanding pin 38, preferably together as a single integral unit.

Upstanding wall portions 166 are preferably separated by slots or openings 172 which permit controlled transfer of ink from ink retention member 180 to outer cylindrical ink roll 54. The number, size, location and shape of slots or openings 172 can be adjusted to optimize the ink transfer flow characteristics desired from inner cylindrical ink retension member 160 to outer cylindrical ink roll 54.

Ink retention member 180 is a generally cylindrical member preferably fabricated from a porous material such as porous rubber or reticulated foam. Ink retention member 180 includes outer cylindrical portion 182 which preferably has an outside diameter smaller than the inside diameter of upstanding wall portions of inner cylindrical ink retention support member 162. Ink retension member 180 also preferably includes outwardly extending tabs or ears 184 which extend outwardly away from outer cylindrical portion 182 of ink retention member 180. Outwardly extending tabs or ears 184 are preferably dimensioned to fit into slots or openings 172 in inner cylindrical ink retention support member 162 and have an outside diameter approximately the same size as the inside diameter of outer cylindrical ink roll 54 to provide contact between outwardly extending tabs or ears 184 and outer cylindrical ink roll 54. Ink retention member 180 also has a centrally positioned aperture 186 which has a inside diameter slightly larger than the outside diameter of centrally positioned cylindrical core 168 of inner cylindrical ink retention support member 162 to permit ink retention member 180 to be positioned inside inner cylindrical ink retention support member 162. In use, ink retention member 180 is saturated with a desired reinking ink, preferably having normal ink transfer flow characteristics. In use, ink transfer flow from inner cylindrical ink retention member 160 to outer cylindrical ink roll 54 continues until the ink originally present in ink retention member 180 is depleted.

In the preferred embodiment shown, inner cylindrical ink retention member 160 does not include a cover member since the ink is absorbed and retained in ink retention member 180. However, it should be recognized that inner cylindrical ink retention member 160 could include a cover member if desired. Similary, the preferred embodiment of inner cylindrical ink reservoir 60 does not include an inner ink retention member. However, it should be recognized that inner cylindrical ink reservoir 60 could include an inner ink retention member if desired.

Thus, using the teachings of the present invention, the progressive deterioration of print darkness experienced during the useful life of conventional continuous or endless loop printing ribbon cassettes and reinking devices used in connection therewith is largely resolved. A more consistent uniform transfer of reinking ink to continuous or endless loop printing ribbon 32 is achieved, storage life of continuous or endless loop printing ribbon cassette 10 is extended and the probability of ink leakage from continuous or endless loop printing ribbon cassette 10 is reduced.

Although the present invention has been described above in detail, the same is by way of illustration and example only and is not to be taken as a limitation on the present invention. For example, while slots or apertures 72 in base member 62 of inner ink reservoir 60 has been shown and described as four vertically oriented slots, the number, position, size and configuration of slots or apertures 72 could be readily modified utilizing the teachings of the present invention to optimize the ink transfer flow characteristics desired between inner ink reservoir 60 and outer cylindrical ink roll 54. Accordingly, the scope and content of the present invention are to be defined only by the terms of the appended claims.

What is claimed is:

1. A printing ribbon cassette for printing equipment, comprising:

a printing ribbon cassette base of generally rectangular configuration having a bottom portion, a front portion, a rear portion, an inlet side portion, an outlet side portion, a continuous or endless loop printing ribbon storage cavity and an upstanding pin;

a wall extending upwardly from said bottom portion of said printing ribbon cassette base along said front portion, said rear portion, said inlet portion and said outlet portion;

an inlet guide extending outwardly from said front portion along said inlet side portion of said printing ribbon cassette;

an outlet guide extending outwardly from said front portion along said outlet side portion of said printing ribbon cassette;

a continuous or endless printing ribbon exiting from said printing ribbon cassette through said outlet guide, extending between said outlet guide and said inlet guide, and entering into said printing ribbon cassette through said inlet guide;

a printing ribbon drive gear mechanism for moving said continuous or endless printing ribbon from said inlet guide into said continuous or endless loop printing ribbon storage cavity in said printing ribbon cassette base;

a reinking device rotatably mounted on said upstanding pin on said printing ribbon cassette base, said reinking device including an inner cylindrical ink roll and an outer cylindrical ink roll concentrically positioned in relation to each other, said inner cylindrical ink roll having a first ink and said outer cylindrical roll having a second ink, wherein said first ink is not the same ink as said second ink; and said inner cylindrical ink roll and said outer cylindrical ink roll being rotatable in response to rotational movement of said printing ribbon drive mechanism so that ink is transferred from said outer cylindrical ink roll to said continuous or endless loop printing ribbon through said printing ribbon drive mechanism.

2. The printing ribbon cassette for printing equipment in accordance with claim 1, wherein said first ink has a normal flow rate and said second ink has a higher than normal flow rate and wherein said first ink and said second ink mix in the outer cylindrical ink roll so that ink transferred to said continuous or endless loop printing ribbon has a gradual increase in the ink flow rate to provide consistent darkness of printed images.

3. The printing ribbon cassette for printing equipment in accordance with claim 1, wherein said second ink is a thixotropic ink.

4. A printing ribbon cassette for printing equipment, comprising:

a printing ribbon cassette base of generally rectangular configuration having a bottom portion, a front portion, a rear portion, an inlet side portion, an outlet side portion, a continuous or endless loop printing ribbon storage cavity and an upstanding pin;

a wall extending upwardly from said bottom portion of said printing ribbon cassette base along said front portion, said rear portion, said inlet portion and said outlet portion;

an inlet guide extending outwardly from said front portion along said inlet side portion of said printing ribbon cassette;

an outlet guide extending outwardly from said front portion along said outlet side portion of said printing ribbon cassette;

a continuous or endless printing ribbon exiting from said printing ribbon cassette through said outlet guide, extending between said outlet guide and said inlet guide, and entering into said printing ribbon cassette through said inlet guide;

a printing ribbon drive gear mechanism for moving said continuous or endless printing ribbon from said inlet guide into said continuous or endless loop printing ribbon storage cavity in said printing ribbon cassette base;

a reinking device rotatably mounted on said upstanding pin on said printing ribbon cassette base, said reinking device including an inner ink reservoir and an outer cylindrical ink roll concentrically positioned in relation to each other said inner ink reservoir including a base member having an upstanding cylindrical wall having slots or apertures for permitting controlled transfer flow of ink to said outer cylindrical ink roll; and said inner ink reservoir and said outer cylindrical ink roll being rotatable in response to linear movement of said continuous or endless loop printing ribbon so that ink is transferred from said outer cylindrical ink roll to said continuous or endless printing ribbon.

5. A reinking device for a printing ribbon cassette for printing equipment, said printing ribbon cassette having a continuous or endless loop printing ribbon and a printing ribbon cassette base with an upstanding pin, said reinking device comprising:

an ink retention member, an inner cylindrical ink retention support member having a wall with slots therein and capable of being rotatably positioned on the upstanding pin on the printing ribbon cassette base; and an outer cylindrical ink roll concentrically positioned in relation to said inner cylindrical ink retention support member and said outer cylindrical ink roll being rotatable in response to linear movement of said continuous or endless loop printing ribbon through said printing ribbon cassette to transfer ink from said outer cylindrical ink roll to said continuous or endless loop printing ribbon;

wherein said ink retention member has tabs which fit into the slot in the inner cylindrical ink retention support member to provide contact between said inner cylindrical ink retention support member and said outer cylindrical ink roll.

* * * * *

UNITED STATES PATENT AND TRADEMARK OFFICE

CERTIFICATE OF CORRECTION

PATENT NO. : 5,690,438

DATED : Nov. 25, 1997

INVENTOR(S) : Yaoping Tan et al.

It is certified that error appears in the above-indentified patent and that said Letters Patent is hereby corrected as shown below:

Title page,
item [63], line 2, "Dec. 2, 1993" should be --Dec. 22, 1993--.

Signed and Sealed this

Twentieth Day of October, 1998

Bruce Lehman

*Attest:*

BRUCE LEHMAN

*Attesting Officer*

*Commissioner of Patents and Trademarks*